US011804329B2

(12) United States Patent
Chen

(10) Patent No.: US 11,804,329 B2
(45) Date of Patent: Oct. 31, 2023

(54) TRANSFORMER AND MANUFACTURING METHOD OF TRANSFORMER

(71) Applicants: LITE-ON ELECTRONICS (GUANGZHOU) LIMITED, Guangzhou (CN); Lite-On Technology Corporation, Taipei (TW)

(72) Inventor: Chih-Shan Chen, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 597 days.

(21) Appl. No.: 16/667,914

(22) Filed: Oct. 30, 2019

(65) Prior Publication Data

US 2021/0065968 A1 Mar. 4, 2021

(30) Foreign Application Priority Data

Aug. 27, 2019 (CN) ..... 201910794232.1

(51) Int. Cl.
*H01F 27/32* (2006.01)
*H01F 41/061* (2016.01)
*H01F 27/24* (2006.01)

(52) U.S. Cl.
CPC ..... *H01F 27/325* (2013.01); *H01F 27/24* (2013.01); *H01F 41/061* (2016.01)

(58) Field of Classification Search
CPC ..... H01F 27/325; H01F 27/24; H01F 41/061; H01F 27/306; H01F 41/098; H01F 41/00; H01F 41/06; H01F 5/02; H01F 5/06
See application file for complete search history.

(56) References Cited

U.S. PATENT DOCUMENTS 3,683,495 A * 8/1972 Feather ..... H01F 27/2871 29/605
4,126,844 A * 11/1978 Hollister ..... H01F 27/306 29/605

(Continued)

FOREIGN PATENT DOCUMENTS

CN 1076509 12/2001
CN 207558592 6/2018

(Continued)

OTHER PUBLICATIONS

"Office Action of Taiwan Counterpart Application", dated Oct. 23, 2019, p. 1-p. 13.

(Continued)

*Primary Examiner* — Mang Tin Bik Lian
(74) *Attorney, Agent, or Firm* — JCIPRNET

(57) ABSTRACT

A transformer includes a hollow bobbin, a coil and a magnetic core. The hollow bobbin has a first end surface and a second end surface opposite to each other. In a direction perpendicular to the normals of the first end surface and the second end surface of the hollow bobbin, the hollow bobbin is not configured with any blocking plates extending laterally from the first end surface and the second end surface. The coil is wound on the hollow bobbin to form a bobbin assembly. The magnetic core has an accommodating space, wherein the bobbin assembly is disposed in the accommodating space. A manufacturing method of the transformer is also provided.

7 Claims, 7 Drawing Sheets

(56) References Cited

U.S. PATENT DOCUMENTS 4,173,747 A * 11/1979 Grimes ..... H01F 27/322 336/60
5,559,486 A * 9/1996 Ikenoue ..... H01F 19/04 336/198
5,814,986 A * 9/1998 Goskowicz ..... G01B 7/023 324/207.16
9,570,228 B1 * 2/2017 An ..... H01F 27/2866
2009/0315663 A1 * 12/2009 Kiyono ..... H01F 37/00 336/219
2011/0025445 A1 * 2/2011 Lai ..... H01F 27/306 336/221
2013/0027173 A1 * 1/2013 Ohsawa ..... H01F 27/306 336/220
2013/0293330 A1 * 11/2013 Wu ..... H01F 5/02 336/61
2014/0091891 A1 * 4/2014 Metzler ..... H01F 27/29 336/192
2014/0266537 A1 * 9/2014 Bichler ..... H01F 41/02 336/178
2015/0061808 A1 * 3/2015 Iwakura ..... H01F 27/24 336/178
2017/0278622 A1 * 9/2017 Chen ..... H01F 27/306
2018/0040407 A1 * 2/2018 Yamamoto ..... H01F 3/14
2018/0211769 A1 * 7/2018 Qiao ..... H02M 5/16
2018/0286573 A1 * 10/2018 Miyazaki ..... H01F 27/34
2019/0311846 A1 * 10/2019 Ren ..... H01F 27/306

FOREIGN PATENT DOCUMENTS

| | | |
|---|---|---|
| CN | 207602350 | 7/2018 |
| CN | 208111263 | 11/2018 |
| JP | 2003272934 | 9/2003 |
| TW | 201243882 | 11/2012 |
| TW | 201327594 | 7/2013 |
| TW | M526169 | 7/2016 |

OTHER PUBLICATIONS

"Office Action of China Counterpart Application", dated Jul. 2, 2021, p. 1-p. 7.

* cited by examiner

TRANSFORMER AND MANUFACTURING METHOD OF TRANSFORMER

CROSS-REFERENCE TO RELATED APPLICATION

This application claims the priority benefit of China application serial no. 201910794232.1, filed on Aug. 27, 2019. The entirety of the above-mentioned patent application is hereby incorporated by reference herein and made a part of this specification.

BACKGROUND

1. Technical Field

The disclosure relates to a power supply product, particularly to a transformer and a manufacturing method of the transformer.

2. Description of Related Art

In order to conform to the development trend of thinning of power supply products, the overall size of the transformer is gradually reduced, and especially, it is the most common practice to reduce the thickness of a bobbin in a transformer. Generally speaking, the bobbin is mostly provided with an upper blocking plate and a lower blocking plate. The upper blocking plate extends from a side edge of an upper end of the bobbin, and the lower blocking plate extends from a side edge of a lower end of the bobbin. A coil is wound on the bobbin and located between the upper blocking plate and the lower blocking plate. Further, the upper blocking plate and the lower blocking plate are used to define upper and lower limits of a winding space of the coil. In a case where the distance between the upper blocking plate and the lower blocking plate decreases with the reducing thickness of the bobbin, although the development trend of thinning of products is conformed to, sufficient winding space cannot be provided for the coil, and even the transformation efficiency of the transformer is affected.

SUMMARY

The disclosure provides a transformer and a manufacturing method of the transformer, which not only conform to the development trend of thinning of products, but also meet a design requirement for high power density.

An embodiment of the disclosure provides a transformer, including a hollow bobbin, a coil and a magnetic core. The hollow bobbin includes a first end surface and a second end surface opposite to each other. In a direction perpendicular to the normals of the first end surface and the second end surface of the hollow bobbin, the hollow bobbin is not configured with any blocking plates extending laterally from the first end surface and the second end surface. The coil is wound on the hollow bobbin to form a bobbin assembly. The magnetic core includes an accommodating space. The bobbin assembly is disposed in the accommodating space.

In an embodiment of the disclosure, the magnetic core includes a first magnetic core and a second magnetic core, and the bobbin assembly is disposed between the first magnetic core and the second magnetic core. The first magnetic core includes a first inner surface facing the first end surface, and the second magnetic core includes a second inner surface facing the second end surface. The first inner surface of the first magnetic core maintains a first gap with the first end surface of the hollow bobbin, and the second inner surface of the second magnetic core maintains a second gap with the second end surface of the hollow bobbin.

In an embodiment of the disclosure, the first magnetic core includes a first recess, and the second magnetic core includes a second recess. The first recess communicates with the second recess to form the accommodating space.

In an embodiment of the disclosure, the coil includes a first end and a second end. The first end is adjacent to the first end surface, and the second end is adjacent to the second end surface.

In an embodiment of the disclosure, the first end of the coil is flush with the first end surface of the hollow bobbin.

In an embodiment of the disclosure, the second end of the coil is flush with the second end surface of the hollow bobbin.

In an embodiment of the disclosure, the first inner surface of the first magnetic core maintains the first gap with the first end of the coil, and the second inner surface of the second magnetic core maintains the second gap with the second end of the coil.

In an embodiment of the disclosure, the transformer further includes an insulation film. The insulation film is attached to the first end of the coil and located in the first gap.

In an embodiment of the disclosure, the transformer further includes an insulation film. The insulation film is attached to the second end of the coil and located in the second gap.

In an embodiment of the disclosure, the transformer further includes a glue layer. The glue layer is disposed in the first gap and contacts the first end of the coil and the first inner surface of the first magnetic core.

In an embodiment of the disclosure, the transformer further includes a glue layer. The glue layer is disposed in the second gap and contacts the second end of the coil and the second inner surface of the second magnetic core.

In an embodiment of the disclosure, the transformer further includes an insulation film. The insulation film is attached to a periphery of the coil, and the coil is located between the hollow bobbin and the insulation film.

In an embodiment of the disclosure, the transformer further includes a carrier. The carrier is sleeved on a periphery of the magnetic core.

An embodiment of the disclosure provides a manufacturing method of a transformer, which includes steps as follows. Firstly, a coil is wound on a hollow bobbin. The hollow bobbin includes a first end surface and a second end surface opposite to each other, and in a direction perpendicular to the normals of the first end surface and the second end surface of the hollow bobbin, a first blocking plate extends laterally from the first end surface and a second blocking plate extends laterally from the second end surface. The first blocking plate and the second blocking plate are configured to limit the coil. Next, the first blocking plate and the second blocking plate are removed such that the hollow bobbin and the coil form a bobbin assembly. Then, a magnetic core is provided. The magnetic core includes an accommodating space, and the bobbin assembly is mounted into the accommodating space.

In an embodiment of the disclosure, the coil includes a first end and a second end, and before the bobbin assembly is mounted into the accommodating space, a first insulation film is attached to the first end of the coil and a second insulation film is attached to the second end of the coil.

In an embodiment of the disclosure, the coil includes a first end and a second end, and in the process of mounting the bobbin assembly into the accommodating space, a first glue layer is formed between the first end of the coil and the magnetic core and a second glue layer is formed between the second end of the coil and the magnetic core.

In an embodiment of the disclosure, the first blocking plate and the second blocking plate are detachably mounted to the first end surface and the second end surface of the hollow bobbin by a mounting manner, and the mounting manner includes engagement, magnetic attraction, gluing or clamping.

In an embodiment of the disclosure, the manufacturing method of the transformer further includes positioning the hollow bobbin on a positioning fixture. The positioning fixture includes the first blocking plate and the second blocking plate, such that the first blocking plate contacts the first end surface of the hollow bobbin and the second blocking plate contacts the second end surface of the hollow bobbin.

Based on the above, in the transformer according to an embodiment of the disclosure, the hollow bobbin includes the first end surface and the second end surface opposite to each other, and the hollow bobbin is not configured with any blocking plates extending outward from the first end surface and the second end surface, thereby reducing the thickness of the bobbin assembly formed by the coil and the hollow bobbin. Therefore, the transformer according to an embodiment of the disclosure not only conforms to the development trend of thinning of products, but also meets the design requirement for high power density. In another aspect, the manufacturing method of the transformer according to an embodiment of the disclosure is used to manufacture the above transformer, and the manufacturing procedure is easy to comprehend and implement.

In order to make the aforementioned and other objectives and advantages of the disclosure comprehensible, embodiments accompanied with figures are described in detail below.

DESCRIPTION OF THE EMBODIMENTS

Figure 1A:
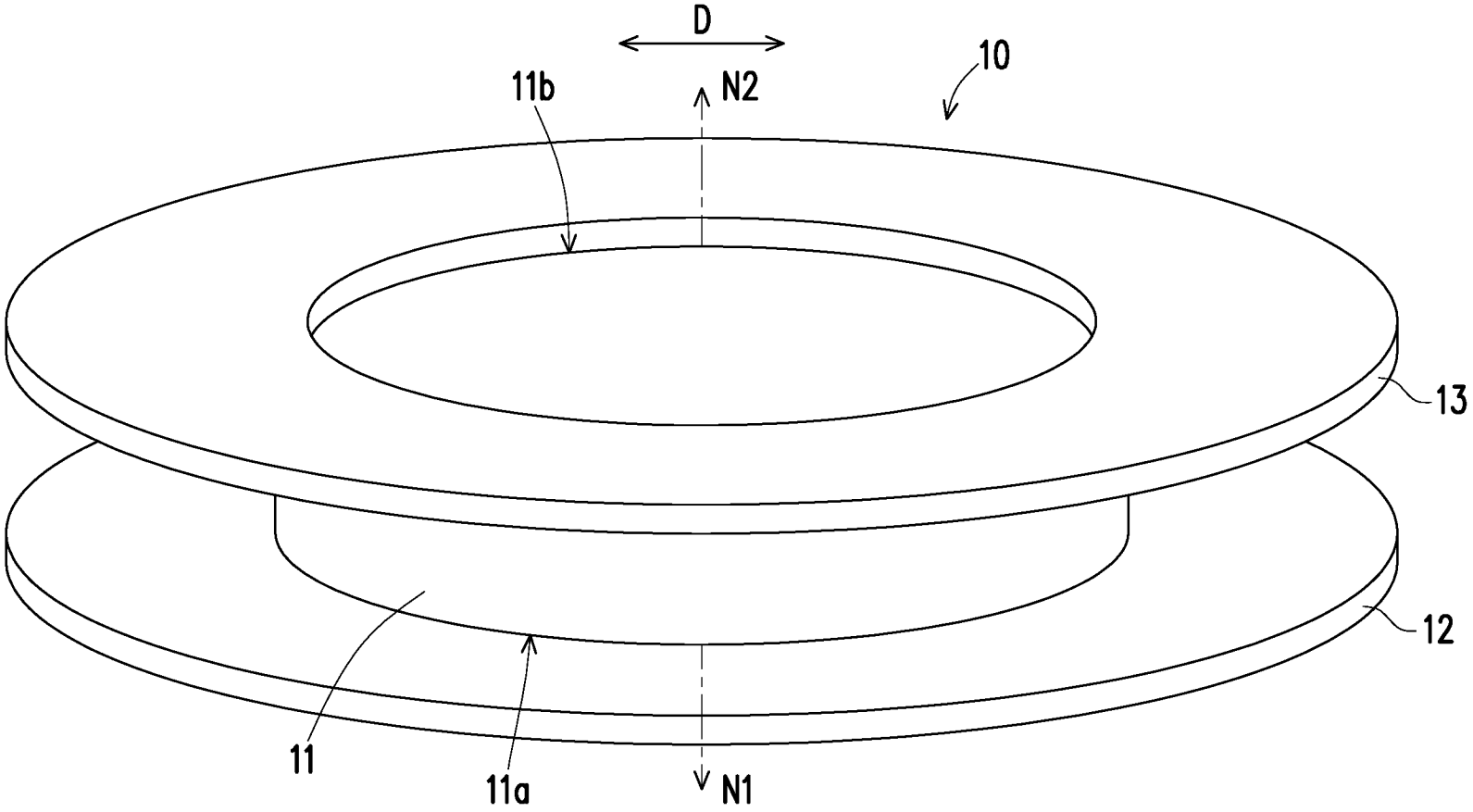
FIG. 1A to FIG. 1C are schematic views showing a manufacturing process of a bobbin assembly in a transformer according to an embodiment of the disclosure.
Figure 1B:
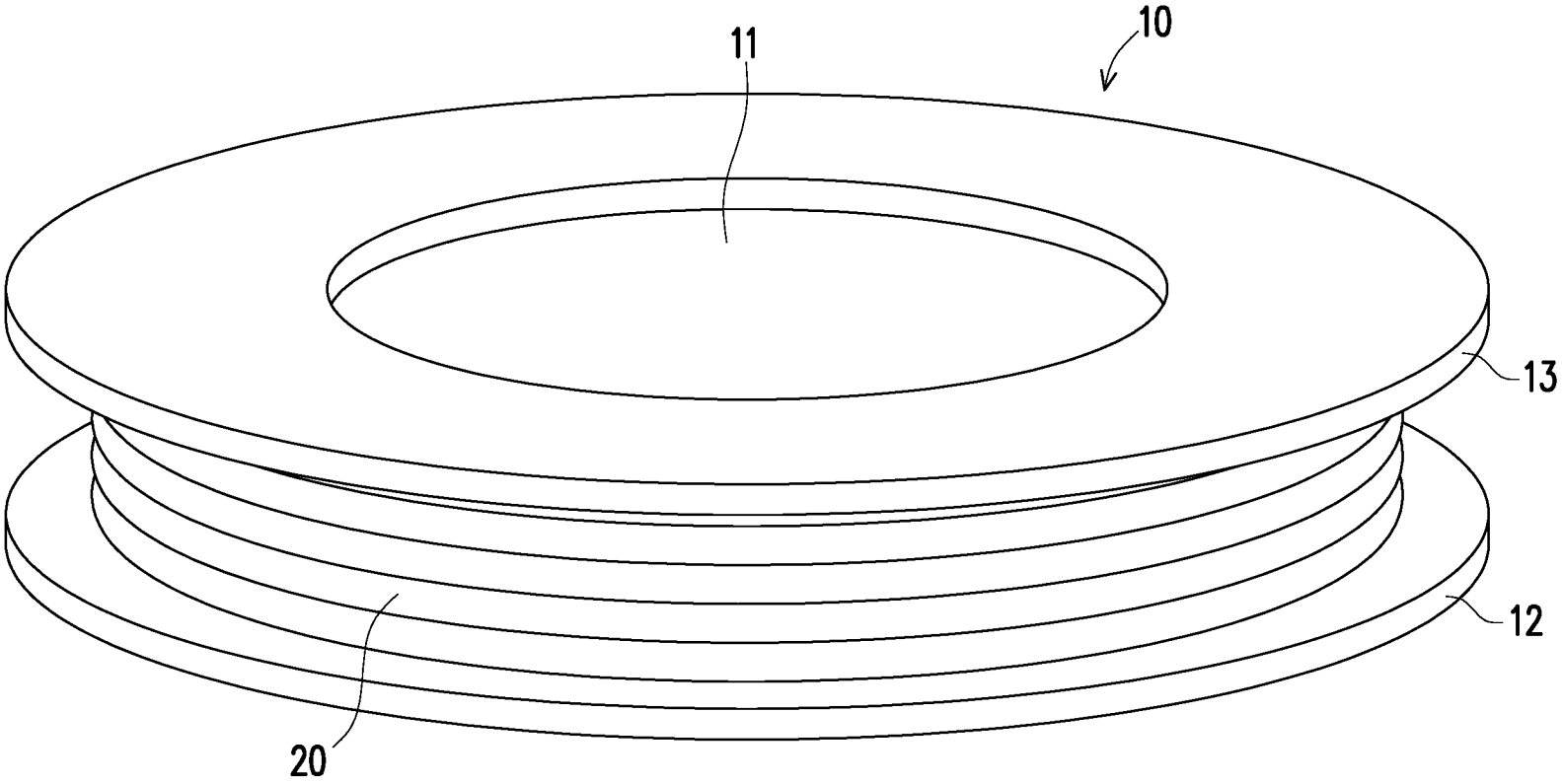
Figure 1C:
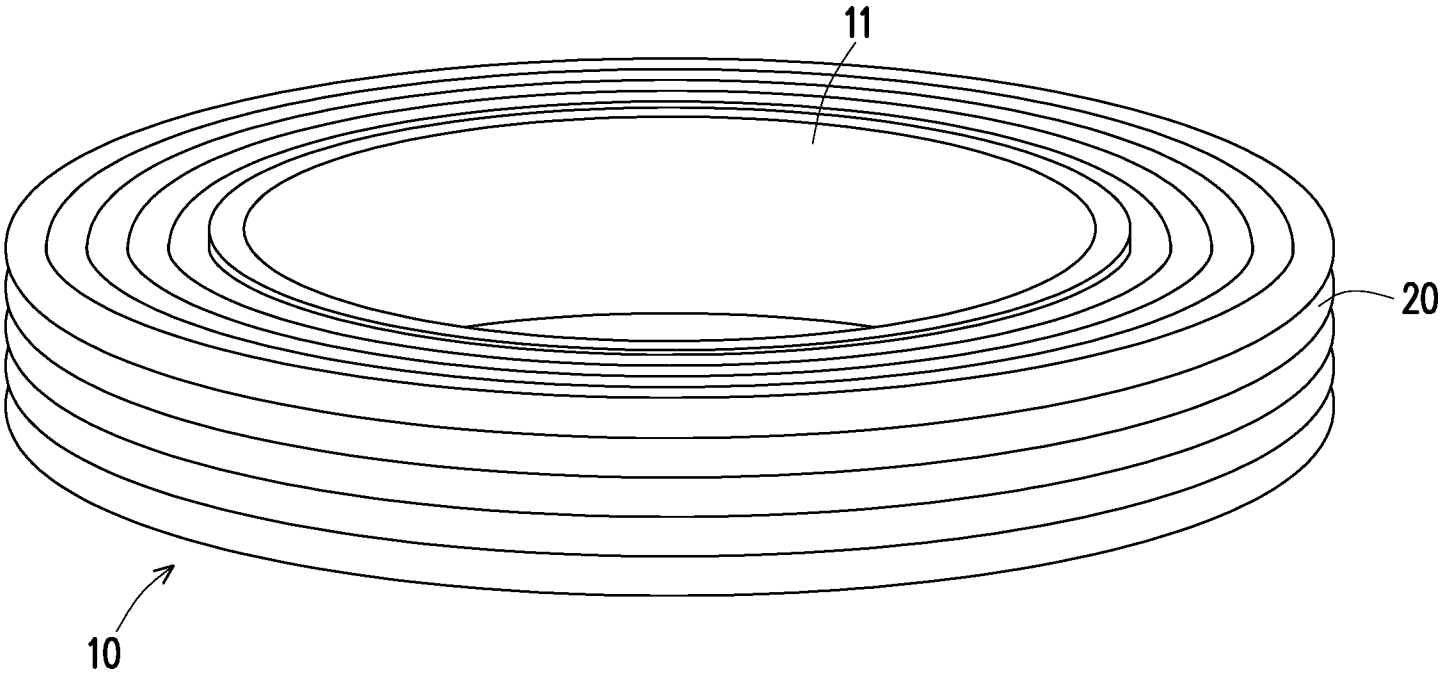

FIG. 1A to FIG. 1C are schematic views showing a manufacturing process of a bobbin assembly in a transformer according to an embodiment of the disclosure. Firstly, referring to FIG. 1A, a hollow bobbin 11 is provided. The hollow bobbin 11 is a hollow cylinder, but is not limited thereto. In other embodiments, the hollow bobbin is a hollow square cylinder or other hollow polygonal cylinders. Specifically, the bobbin 11 includes a first end surface 11*a* and a second end surface 11*b* opposite to each other, and in a direction D perpendicular to a normal N1 of the first end surface 11*a* and a normal N2 of the second end surface 11*b*, a first blocking plate 12 extends outward from the first end surface 11*a* and the second blocking plate 13 extends outward from the second end surface 11*b*. More specifically, the first blocking plate 12 is detachably mounted to the first end surface 11*a*, and the second blocking plate 13 is detachably mounted to the second end surface 11*b*.

In one of the implementable mounting manners, the first blocking plate 12 and the second blocking plate 13 are part of a positioning fixture. The hollow bobbin 11 is sleeved on a positioning shaft of the positioning fixture. The first blocking plate 12 and the second blocking plate 13 are arranged in parallel on the positioning shaft, and the hollow bobbin 11 is positioned between the first blocking plate 12 and the second blocking plate 13. The first blocking plate 12 is connected to or contacts the first end surface 11*a*, and the second blocking plate 13 is connected to or contacts the second end surface 11*b*. By removing the hollow bobbin 11 from the positioning fixture, the first blocking plate 12 and the second blocking plate 13 are removed from the first end surface 11*a* and the second end surface 11*b* of the hollow bobbin 11.

In another implementable mounting manner, the first blocking plate 12 and the second blocking plate 13 are positioned on the first end surface 11*a* and the second end surface 11*b* of the hollow bobbin 11 by a manner such as engagement, magnetic attraction, gluing, clamping or the like. By releasing the engagement relationship, magnetic attraction relationship, gluing relationship or clamping relationship between the first blocking plate 12 and the first end surface 11*a* of the hollow bobbin 11, the first blocking plate 12 is removed from the first end surface 11*a* of the hollow bobbin 11. In another aspect, by releasing the engagement relationship, magnetic attraction relationship, gluing relationship or clamping relationship between the second blocking plate 13 and the second end surface 11*b* of the hollow bobbin 11, the second blocking plate 13 is removed from the second end surface 11*b* of the hollow bobbin 11.

In still another implementable mounting manner, the first blocking plate 12 and the second blocking plate 13 are connected to the first end surface 11*a* and the second end surface 11*b* of the hollow bobbin 11 by a breakable connecting portion. By breaking the breakable connecting portion, the first blocking plate 12 and the second blocking plate 13 are removed from the first end surface 11*a* and the second end surface 11*b* of the hollow bobbin 11.

In the present embodiment, the first blocking plate 12 and the second blocking plate 13 are annular blocking plates and surround the hollow bobbin 11. The first blocking plate 12 and the second blocking plate 13 are parallel to each other and are used to define upper and lower limits of the wound coil. Next, referring to FIG. 1B, the coil 20 is wound on the hollow bobbin 11. The first blocking plate 12 and the second blocking plate 13 generate a limiting effect on the coil 20 to improve the flatness of the coil 20. After the step of winding the coil 20 is completed, the first blocking plate 12 and the second blocking plate 13 are removed from the first end surface 11*a* and the second end surface 11*b* of the hollow bobbin 11, such that the hollow bobbin 11 and the coil 20 form a bobbin assembly 10, as shown in FIG. 1C.

Since the hollow bobbin 11 in the bobbin assembly 10 is not configured with the blocking plates extending outward from the first end surface 11*a* and the second end surface 11*b*, the thickness of the bobbin assembly 10 is reduced, thereby conforming to the development trend of thinning of products.

Figure 2A:
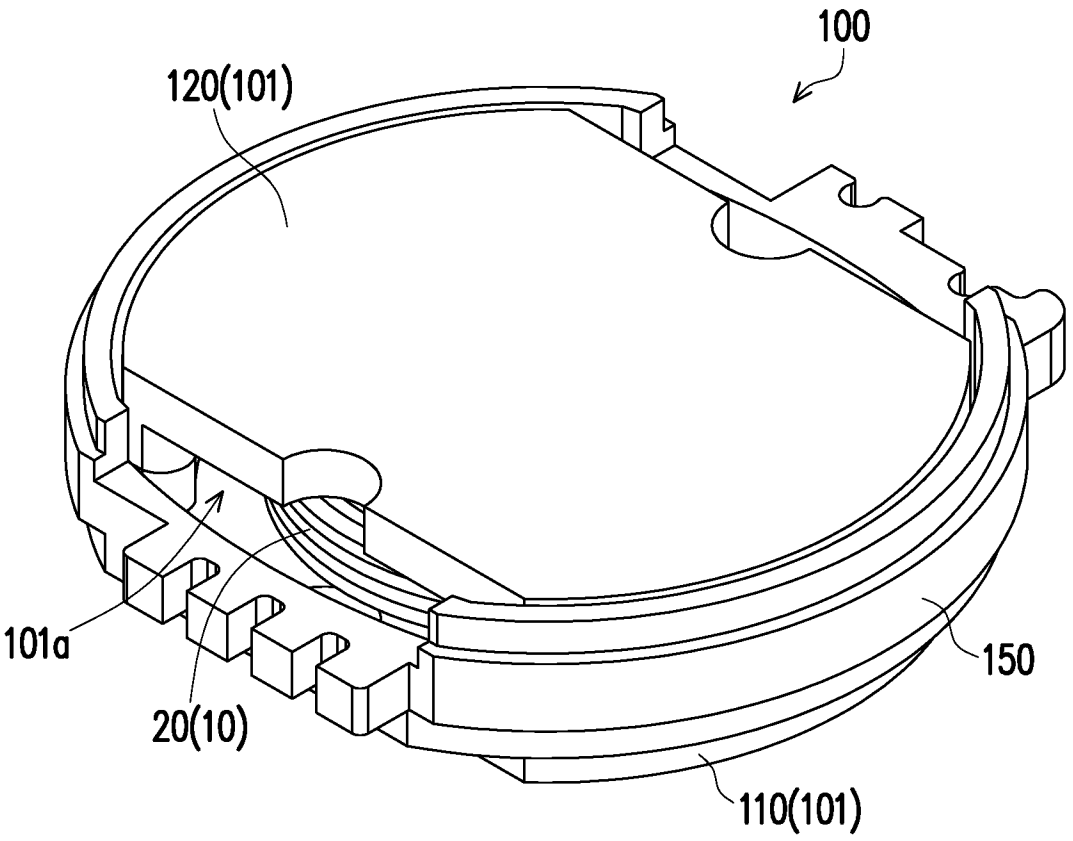
FIG. 2A is a schematic view of a transformer according to an embodiment of the disclosure.
Figure 2B:
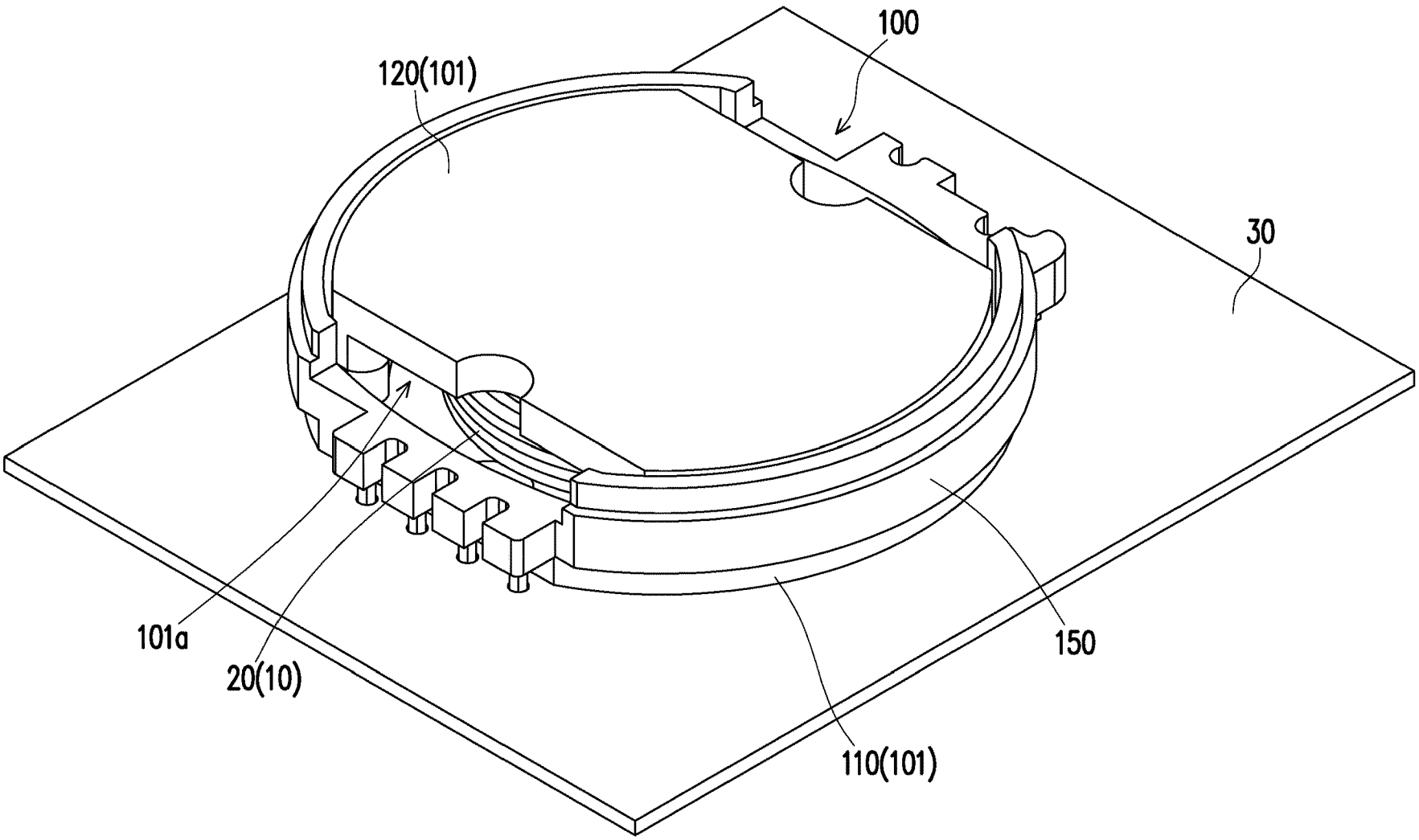
FIG. 2B is a schematic view of the transformer of FIG. 2A mounted on a circuit board.
Figure 2C:
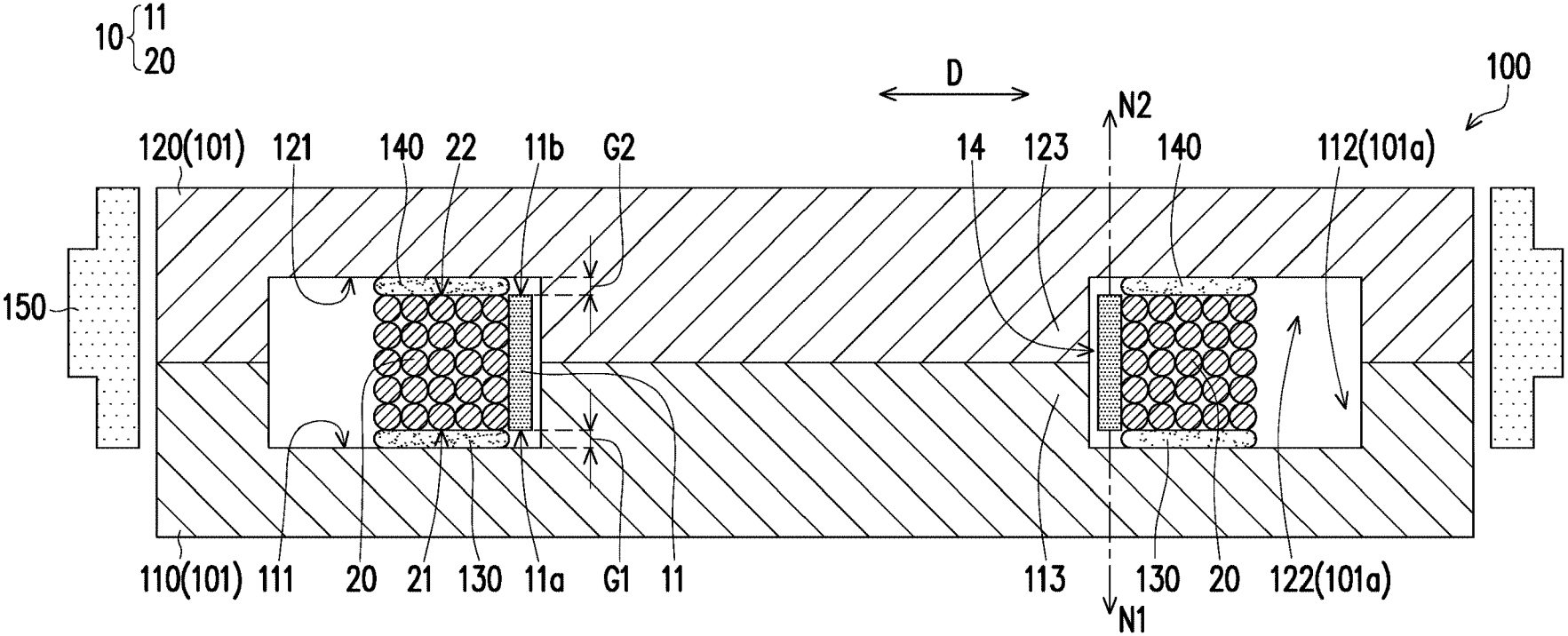
FIG. 2C is a schematic cross-sectional view of the transformer of FIG. 2A.

FIG. 2A is a schematic view of a transformer according to an embodiment of the disclosure. FIG. 2B is a schematic view of the transformer of FIG. 2A mounted on a circuit board. FIG. 2C is a schematic cross-sectional view of the transformer of FIG. 2A. Referring to FIG. 2A to FIG. 2C, in the present embodiment, the transformer 100 includes a bobbin assembly 10 and a magnetic core 101. The bobbin assembly 10 includes a hollow bobbin 11 and a coil 20, and the coil 20 is wound on the hollow bobbin 11. In detail, the hollow bobbin 11 includes a first end surface 11*a* and a second end surface 11*b* opposite to each other, and in a direction D perpendicular to a normal N1 of the first end surface 11*a* and a normal N2 of the second end surface 11*b*, the hollow bobbin 11 is not provided any blocking plates extending outward from the first end surface 11*a* and extending outward from the second end surface 11*b*.

The magnetic core 101 includes an accommodating space 101*a*, and the bobbin assembly 10 is disposed in the accommodating space 101*a*. For example, the magnetic core 101 includes a first magnetic core 110 and a second magnetic core 120, and the bobbin assembly 10 is disposed between the first magnetic core 110 and the second magnetic core 120. The first magnetic core 110 includes a first inner surface 111 facing the first end surface 11*a*, and the second magnetic core 120 includes a second inner surface 121 facing the second end surface 11*b*. In another aspect, the first magnetic core 110 includes a first recess 112, and the first inner surface 111 is the bottom surface of the first recess 112. The second magnetic core 120 includes a second recess 122, and the second inner surface 121 is the bottom surface of the second recess 122. Further, the first recess 112 of the first magnetic core 110 and the second recess 122 of the second magnetic core 120 communicate with each other to form the accommodating space 101*a*. In another aspect, the first magnetic core 110 includes a first protrusion 113, and the second magnetic core 120 includes a second protrusion 123. The first protrusion 113 and the second protrusion 123 are inserted into a through hole 14 of the hollow bobbin 11 and are in contact with each other.

In the present embodiment, the first inner surface 111 of the first magnetic core 110 maintains a first gap G1 with the first end surface 11*a* of the hollow bobbin 11, and the second inner surface 121 of the second magnetic core 120 maintains a second gap G2 with the second end surface 11*b* of the hollow bobbin 11. Specifically, the coil 20 includes a first end 21 and a second end 22. The first end 21 faces the first inner surface 111 of the first magnetic core 110 and is adjacent to the first end surface 11*a* of the hollow bobbin 11, and the second end 22 faces the second inner surface 121 of the second magnetic core 120 and is adjacent to the second end surface 11*b* of the hollow bobbin 11. The first end 21 of the coil 20 also maintains the first gap G1 with the first inner surface 111 of the first magnetic core 110, and the second end 22 of the coil 20 also maintains the second gap G2 with the second inner surface 121 of the second magnetic core 120.

The first gap G1 and the second gap G2 are both air gaps. In order to stably position the hollow bobbin 11 and the coil 20 between the first magnetic core 110 and the second magnetic core 120, the transformer 100 further includes a first glue layer 130 and a second glue layer 140. The first glue layer 130 is disposed in the first gap G1 and contacts the first end 21 of the coil 20 and the first inner surface 111 of the first magnetic core 110. The second glue layer 140 is disposed in the second gap G2 and contacts the second end 22 of the coil 20 and the second inner surface 121 of the second magnetic core 120. The bobbin assembly 10 is glued and fixed into the first recess 112 of the first magnetic core 110 and the second recess 122 of the second magnetic core 120 by the first glue layer 130 and the second glue layer 140. In another aspect, the first glue layer 130 and the second glue layer 140 are configured to separate the coil 20 from the first magnetic core 110 and separate the coil 20 from the second magnetic core 120.

For example, the first end 21 of the coil 20 is flush with the first end surface 11*a* of the hollow bobbin 11, and the second end 22 of the coil 20 is flush with the second end surface 11*b* of the hollow bobbin 11. Since the hollow bobbin 11 in the bobbin assembly 10 is not configured with the blocking plates extending outward from the first end surface 11*a* and the second end surface 11*b*, after the bobbin assembly 10 is mounted between the first magnetic core 110 and the second magnetic core 120, the thickness of the overall structure is reduced.

Under the same thickness setting, the bobbin of the common transformer will be limited by the upper and lower blocking plates, so sufficient winding space cannot be provided for the coil. In contrast, the hollow bobbin 11 of the transformer 100 of the present embodiment includes no limit in the upper and lower blocking plates, so that sufficient winding space is provided for the coil 20. That is, the transformer 100 of the present embodiment not only conforms to the development trend of thinning of products, but also meets the design requirement for high power density.

For the step of mounting the bobbin assembly 10 into the accommodating space 101*a* of the magnetic core 101, in the process of mounting the bobbin assembly 10 into the accommodating space 101*a* of the magnetic core 101, firstly, a first glue layer 130 is formed between the first inner surface 111 of the first recess 112 of the first magnetic core 110 and the first end 21 of the coil 20, and a second glue layer 140 is formed between the second inner surface 121 of the second recess 122 of the second magnetic core 120 and the second end 22 of the coil 20. For example, the first glue layer 130 is coated on the first inner surface 111 of the first recess 112 of the first magnetic core 110, and the second glue layer 140 is coated on the second inner surface 121 of the second recess 122 of the second magnetic core 120. Next, the bobbin assembly 10 is disposed between the first magnetic core 110 and the second magnetic core 120, and the first magnetic core 110 and the second magnetic core 120 are moved to abut against each other to position the bobbin assembly 10 between the first magnetic core 110 and the second magnetic core 120, such that one portion of the bobbin assembly 10 is accommodated in the first recess 112 of the first magnetic core 110, and another portion of the bobbin assembly 10 is accommodated in the second recess 122 of the second magnetic core 120. Thereby, the bobbin assembly 10 is attached to the first glue layer 130 through the first end 21 of the coil 20 and is attached to the second glue layer 140 through the second end 22 of the coil 20.

In the present embodiment, the transformer 100 further includes a carrier 150. The carrier 150 is an annular structure and is sleeved on the periphery of the first magnetic core 110 and the second magnetic core 120. The first magnetic core 110 and the second magnetic core 120 are fixed in the carrier 150, and the coil 20 is electrically connected to a circuit board 30 through the carrier 150.

Figure 3:
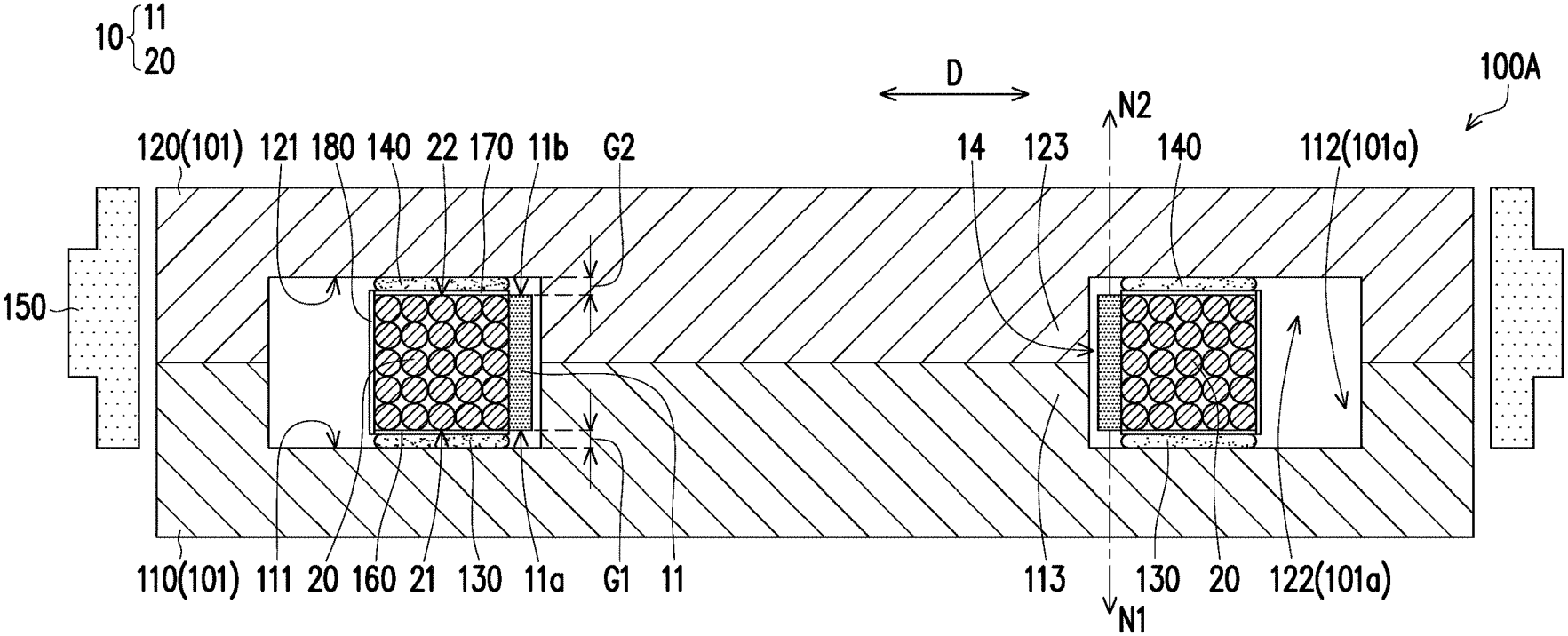
FIG. 3 is a schematic cross-sectional view of a transformer according to another embodiment of the disclosure.

FIG. 3 is a schematic cross-sectional view of a transformer according to another embodiment of the disclosure. Referring to FIG. 3, the transformer 100A of the present embodiment is substantially similar to the transformer 100 of the previous embodiment. The difference between the two is that the transformer 100A further includes a first insulation film 160, a second insulation film 170 and a third insulation film 180.

The first insulation film 160 is located in the first gap G1. The first insulation film 160 is attached to the first end 21 of the coil 20, and the first insulation film 160 is located between the first glue layer 130 and the first end 21 of the coil 20. The second insulation film 170 is located in the second gap G2. The second insulation film 170 is attached to the second end 22 of the coil 20, and located between the second glue layer 140 and the second end 22 of the coil 20. In another aspect, the third insulation film 180 is attached to the periphery of the coil 20, and the coil 20 is located between the hollow bobbin 11 and the third insulation film 180. Specifically, the first insulation film 160, the second insulation film 170 and the third insulation film 180 are configured to separate the coil 20 from the first magnetic core 110 and separate the coil 20 from the second magnetic core 120.

It should be noted that before the bobbin assembly 10 is mounted into the accommodating space 101*a* of the magnetic core 101, the first insulation film 160 must be attached to the first end 21 of the coil 20, the second insulation film 170 is attached to the second end 22 of the coil 20 and the third insulation film 180 is attached to the periphery of the coil 20. Then, the bobbin assembly 10 is mounted into the accommodating space 101*a* of the magnetic core 101. In addition, for the step of mounting the bobbin assembly 10 into the accommodating space 101*a* of the magnetic core 101, reference may be roughly made to the description of the previous embodiment, and the descriptions thereof are omitted herein.

Based on the above, in the transformer according to an embodiment of the disclosure, the hollow bobbin includes the first end surface and the second end surface opposite to each other, and the hollow bobbin is not configured with any blocking plates extending outward from the first end surface and the second end surface, thereby reducing the thickness of the bobbin assembly formed by the coil and the hollow bobbin. Therefore, the transformer according to an embodiment of the disclosure not only conforms to the development trend of thinning of products, but also meets the design requirement for high power density. In another aspect, the manufacturing method of the transformer according to an embodiment of the disclosure is used to manufacture the above transformer, and the manufacturing procedure is easy to comprehend and implement.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. A transformer, comprising:

a hollow bobbin, comprising a first end surface and a second end surface opposite to each other, wherein in a direction perpendicular to normals of the first end surface and the second end surface of the hollow bobbin, the hollow bobbin is not configured with any blocking plates extending laterally from the first end surface and the second end surface;

a coil, wound on the hollow bobbin to form a bobbin assembly; and a magnetic core, comprising an accommodating space, wherein the bobbin assembly is disposed in the accommodating space, wherein the magnetic core comprises a first magnetic core and a second magnetic core, the first magnetic core comprising a first inner surface facing the first end surface, and the second magnetic core comprising a second inner surface facing the second end surface, there is no insulating plate between the first inner surface and the first end surface, and there is no insulating plate between the second inner surface and the second end surface, the first inner surface of the first magnetic core maintains a first gap with the first end surface of the hollow bobbin, the coil comprises a first end, the first end being adjacent to the first end surface, the first inner surface of the first magnetic core maintains the first gap with the first end of the coil, the bobbin assembly is disposed between the first magnetic core and the second magnetic core, wherein the second inner surface of the second magnetic core maintains a second gap with the second end surface of the hollow bobbin, the coil comprises the second end being adjacent to the second end surface, the second inner surface of the second magnetic core maintains the second gap with the second end of the coil, the transformer further comprising:

a first glue layer, disposed in the first gap and contacting the first end of the coil and the first inner surface of the first magnetic core, a second glue layer, disposed in the second gap and contacting the second end of the coil and the second inner surface of the second magnetic core.

2. The transformer according to claim 1, wherein the first magnetic core comprises a first recess, and the second magnetic core comprises a second recess, the first recess communicating with the second recess to form the accommodating space.

3. The transformer according to claim 1, wherein the first end of the coil is flush with the first end surface of the hollow bobbin.

4. The transformer according to claim 1, wherein the second end of the coil is flush with the second end surface of the hollow bobbin.

5. The transformer according to claim 1, further comprising:

an insulation film, attached to a periphery of the coil, wherein the coil is located between the hollow bobbin and the insulation film.

6. The transformer according to claim 1, further comprising:

a carrier, sleeved on a periphery of the magnetic core.

7. The transformer according to claim 1, wherein the first magnetic core includes a first protrusion, and the second magnetic core includes a second protrusion, the first protrusion and the second protrusion are inserted into a through hole of the hollow bobbin and are in contact with each other.

* * * * *